US005964408A

United States Patent [19]

Musson

[11] Patent Number: 5,964,408

[45] Date of Patent: Oct. 12, 1999

[54] IRRIGATION SPRINKLER AND VALVE WITH FLUSHING SYSTEM

[76] Inventor: Cyril D. Musson, 2721 N. Windsor Ave., Altadena, Calif. 91001

[21] Appl. No.: 08/892,221

[22] Filed: Jul. 14, 1997

[51] Int. Cl.[6] ..... B05B 15/02

[52] U.S. Cl. ..... 239/123; 239/203; 239/205; 239/113; 239/114; 251/35; 277/550; 92/87; 92/168; 285/110

[58] Field of Search ..... 239/106, 108, 239/113, 114, 115, 123, 203–206, 230; 251/29, 35, 46; 277/550, 558, 562, 577; 92/87, 168; 285/110, 133.4

[56] References Cited

U.S. PATENT DOCUMENTS

| | | | |
|---|---|---|---|
| 2,573,369 | 10/1951 | Snoddy | 251/46 X |
| 3,020,925 | 2/1962 | Randall et al. | 251/35 X |
| 3,712,578 | 1/1973 | Dawson | 251/35 |
| 3,921,910 | 11/1975 | Hayes et al. | 239/205 |
| 3,934,820 | 1/1976 | Phaup | 239/205 |
| 4,058,287 | 11/1977 | Fromfield | 251/46 |
| 4,173,306 | 11/1979 | Ridgway | 239/230 |
| 4,682,732 | 7/1987 | Walto | 239/206 X |
| 5,137,307 | 8/1992 | Kinsey | 239/203 X |

*Primary Examiner*—Andres Kashnikow
*Assistant Examiner*—Steven J. Ganey
*Attorney, Agent, or Firm*—Albert O. Cota

[57] ABSTRACT

An improved pop-up irrigation sprinkler with integral flow control valve, and an improved separate flow control valve, defined by a dual flowpath for pilot flow within the flow control valve; a stem-flushing feature using an interrupter disc (54) mounted on a piston (48), providing a flowpath for a brief hydraulic flushing cycle after a momentary interruption of flow; a direct acting hydraulic pilot valve (92) to permit hydraulic control of an electric type sprinkler or a separate flow control valve; an improvement of the bearing guide (80) by the addition of a resilient barrier seal (84) to prevent seizing of the stem to the bearing guide when fully extended, the seal maintaining a close fit to the stem and yet being sufficiently resilient to permit the flushing of the stem; and a variable orifice in the inlet to the bonnet chamber to retard the initial opening rate of the valve.

24 Claims, 8 Drawing Sheets

3/8

IRRIGATION SPRINKLER AND VALVE WITH FLUSHING SYSTEM

TECHNICAL FIELD

The invention pertains to irrigation sprinklers in general which are controlled electrically or hydraulically, and more specifically to sprinklers for golf courses, athletic fields, parks etc.

BACKGROUND ART

Previously, many types of pop-up sprinklers have been used to provide an effective means for producing an even distribution of water over a large area by popping-up from the ground surface, spraying the turf and retracting automatically after use. Pop-up sprinklers have been in use for decades, allowing lawns and turf to be automatically irrigated and machine mowed without the necessity of manually adjusting or removing the sprinklers. In most cases, the sprinklers are hydraulically-actuated to achieve the upwardly extending movement and many types of seals have been employed to prevent clogging and increase reliability.

A search of the prior art did not disclose any patents that read directly on the claims of the instant invention, however the following U.S. patents are considered related:

| U.S. PAT. NO. | INVENTOR | ISSUED |
|---|---|---|
| 5,423,486 | Hunter | 13 June 1995 |
| 5,368,229 | Hayes, et al | 29 Nov. 1994 |
| 5,123,597 | Bendall | 23 June 1992 |
| 5,104,090 | Grizzle, et al | 14 April 1992 |
| 4,886,209 | Dawn | 12 Dec. 1989 |
| 4,834,289 | Hunter | 30 May 1989 |
| 4,796,809 | Hunter | 10 Jan. 1989 |
| 4,316,579 | Ray et al | 23 Feb. 1982 |
| 4,244,555 | Maggioni, et al | 13 Jan. 1981 |
| 3,921,910 | Hayes, et al | 25 Nov. 1975 |

U.S. Pat. No. 5,423,486 issued to Hunter is for a pop-up sprinkler unit that includes a floating sleeve of grit resistant material. The sleeve is reciprocally mounted between the inner and outer housings for deflecting grit when the sleeve is retracted.

U.S. Pat. No. 5,123,597 of Bendall teaches a sprinkler nozzle with a curved outlet section to enhance the reach of the nozzle while maintaining a coherent or homogenous water stream.

U.S. Pat. No. 4,886,209 invented by Dawn discloses a sprinkler with a pop-up stem and a valve cover blocking the opening to the stem. A resiliently deformable valve element is loosely mounted to enable particulate material to be moved in a planar direction.

Patent of Hunter issued under U.S. Pat. No. 4,796,809 described a two-stage pop-up sprinkler that employs a cylindrical housing and a telescoping sleeve reciprocally mounted on the sleeve. An inner sleeve contains the sprinkler head and driving mechanism. The first sleeve extends primarily from the housing for ground clearance then the second sleeve expands upwardly permitting water to be distributed.

U.S. Pat. No 3,921,910 issued to Hayes, et al teaches a pop-up sprinkler with an annular seal providing a static seal, spring seat and pressure responsive leakage path to remove debris during extended movement of the sprinkler head. The annular seal also provides a seal when the head is extended and delivers a wiping action when the head is retracted.

For background purposes and as indicative of the art to which the invention relates reference may be made to the patents issued to Hayes, et al, Grizzle et al, Hunter, Ray, et al, and Maggioni, et al.

DISCLOSURE OF THE INVENTION

Irrigation sprinkler systems commonly used on golf courses, parks, athletic fields, and similar locations usually it employ pop-up type sprinklers that extend above the ground when in use and retract when the irrigation is completed. This type of sprinkler typically has a pop-up stem 22 slidably disposed in a bearing guide 80 which is sealably retained in a sprinkler case 20 with a stem retracting spring 26, and a pop-up seal 24. In addition, one type of sprinkler, referred to within the industry as a valve-in-head sprinkler, has an integral flow control valve in the base, as shown in FIG. 3. A second type of sprinkler is controlled by a separate flow control valve in the supply line. FIG. 17 illustrates one type of separate flow control valve as it exists in prior art. Both the integral valve and the separate valves which are the subject of the invention are the type that have continuous pilot flow through the bonnet chamber when the valve is open.

Certain internal components of such flow control valves, namely a piston 48, a piston guide 46, and a flow control valve diaphragm 42, move in one direction when the valve opens, and in the opposite direction when it closes. The opening motion is referred to as an opening stroke, and the closing motion, as a closing stroke.

The opening and closing of the valve are actuated by a pilot valve 90 or 92, which controls a very small flow of water into a bonnet chamber 50. The bonnet chamber has an inlet through a piston 48 and a piston guide 46, and also an outlet 36. The flow of water into and out of the bonnet chamber is called pilot flow, as distinct from main flow through the flow control valve. The channel through which it flows is called a pilot flowpath, as distinct from a main flowpath.

The pilot valve 90 or 92 is located at the outlet 36 of the bonnet chamber 50. When the pilot valve is closed, pressure builds up in the bonnet chamber 50, forcing the flow control valve to close. When the pilot valve opens, pressure is vented from the bonnet chamber, permitting the flow control valve to open and commence irrigation.

The feature of automatic pop-up and retraction allows any mechanical mowing equipment to traverse the ground without damaging the sprinklers. Conventional designs of this type of sprinkler have been subject to the occasional failure of the pop-up stem to fully retract, due to sand particles or small pebbles becoming wedged between the pop-up stem 22 and the bearing guide 80. This problem can occur either when the stem is popped up or during its retraction mode. While some prior art teaches a pressure responsive leakage path around the interface between stem and bearing guide, the sprinklers in common usage today retract after the flow has stopped, and little or no flushing of the stem occurs. This is because of the very rapid closing rate of a flow control valve at the end of the closing stroke.

As a response to the retraction problem, a primary object of the invention is the addition of a flushing cycle which occurs while the sprinkler pop-up stem 22 is retracting. This flushing cycle is achieved by first decreasing the closing rate of the flow control valve near the end of the closing stroke, and second, interrupting the flow before final shutoff.

Improvements necessary to implement these changes include the following:

a) dual flowpath means for pilot flow, b) a variable orifice at the inlet to the bonnet chamber, c) flow interruption means in the main flowpath of the flow control valve, and d) sealing means on the bearing guide, surrounding the pop-up stem.

It should be noted that most valves, well known in prior art and in common use, have a non-linear closing rate; the closer to shut-off the faster the valve closes due to an increase in the pressure differential. This causes a rapid deceleration of the water in the upstream supply lines, which may result in potentially destructive pressure surges. Also, pressure surges occur downstream of many flow control valves because of a rapid opening rate. Eliminating such pressure surges is another object of the invention.

The dual flowpath means enables the valve to close rapidly for the first part of the closing stroke and slowly during the last part. This prevents closing pressure surges and allows time for the flushing cycle. Flushing is initiated by means of an interrupter disc which moves through a modified seat orifice, momentarily blocking it, and then reopening it to allow sufficient flow to flush the interface between the stem 22 and the bearing guide 80 before the valve closes. The occluding area of the interrupter disc is mounted a short distance upstream of the flow control valve seal 44, and space is provided between it and the seal to form a path for flushing flow.

The addition of a barrier seal is also required to facilitate the flushing cycle. When a pop-up sprinkler is operating, the internal water pressure overcomes the force of the retraction spring and holds the stem in its fully extended position, pressing the pop-up seal against its seat in the bearing guide. When the control valve closes, the case pressure quickly drops and the retraction spring acts to retract the stem. If sand or grit lodges between the stem and bearing guide, the stem may seize and fail to unseat the pop-up seal. When this occurs flushing is not possible.

The purpose of the newly added barrier seal is to keep foreign matter away from the interface between the stem and bearing guide so as to prevent seizing in the fully extended position. The barrier seal is a flexible ring having an outer circumference which is anchored to the bearing guide by barrier is seal retaining means, while the inner circumference closely surrounds the stem, preventing sand or other particulate matter from lodging between the stem and bearing guide. When the flow into the sprinkler is interrupted in preparation for flushing, and the stem begins to retract, the barrier seal flexes downward into a chamfered corner 83 between the stem and the bearing guide, allowing enough movement to unseat the pop-up seal. This opens a flow passage so that flushing can begin. Radial slits in the inner circumference of the seal allow it to open up and accommodate adequate flushing flow as the stem retracts.

The initial opening rate of pressure-activated flow control valves tends to be very rapid due to the high pressure in the bonnet chamber being suddenly vented. This rapid opening rate may cause hazardous pressure surges in the lines downstream of the valve. The use of a secondary flowpath with flow-restricting means further increases this effect, and requires counteractive measures. For this reason a variable pilot flow orifice is provided at the inlet to the bonnet chamber to slow the initial opening rate of the valve. The flow area of the orifice varies during the opening stroke of the valve, slowing the rate at which bonnet chamber pressure decreases, and thus slowing the initial opening response of the valve.

Currently available hydraulically actuated sprinklers do not lend themselves to the above methods. For this reason a hydraulic pilot valve 92 is introduced as a means of extending the application of the four previously mentioned innovations to hydraulically actuated sprinklers. The hydraulic pilot valve replaces the solenoid-operated pilot valve of and electric sprinkler, thus converting it to a hydraulic sprinkler.

It may be easily visualized that the above modifications to the sprinkler and its control valve will completely solve the problem of the sprinkler stem failing to reliably retract when debris or foreign matter is present. One method currently used to avoid failure to retract is to provide a large clearance between the stem and bearing guide. However, this allows excessive flow to escape during pop-up and limits the number of units that can be activated at once. The modification herein described avoids retraction problems even with very small clearance between the stem and bearing guide, and permits more units to be activated simultaneously.

In addition, the introduction of the dual flowpath for pilot flow, and the variable orifice at the inlet to the bonnet chamber effectively solve the problem of water hammer both upstream and downstream of the valve.

While the basic function of the improved closing rate has been described above, a more detailed description follows:

The primary pilot flowpath upstream of the bonnet chamber is basically the same as that used in the prior art, that is, a metering area in a passage through the center of the piston and/or piston guide. However the flowpath is modified to accommodate the variable orifice whose function is to slow the initial rate at which the bonnet chamber evacuates at the beginning of the opening stroke. The orifice presents its largest flow area at the beginning of the opening stroke and decreases this area as the stroke progresses. This allows a large pilot flow into the bonnet chamber when exit flow is at a maximum, and thus slows the initial opening rate. This does not occur, however, until the diverter valve opens when the interrupter disc exits the modified seat orifice.

The secondary flowpath contains flow-restricting means. such as a very small orifice, or series of orifices. The diverter valve is actuated by the stroking of the piston and piston guide, closing the primary pilot flowpath at a pre-determined point in the closing stroke, and forcing the pilot flow to follow the secondary flowpath. The parts are dimensioned to interact so that the diverter valve is open during the first part of the closing stroke, and closes just before the interrupter disc blocks the modified seat orifice. This slows the movement of the piston enough to provide time for the flushing cycle, and also slows the deceleration of the water in the supply lines upstream of the valve sufficiently to avoid closing pressure surges.

When the flow is interrupted the sprinkler stem 22 begins to retract. This opens the pop-up seal 24, providing a path for flushing flow. Then, as the interrupter disc moves through the modified seat orifice, a small flowpath opens up through the space between the edge of the interrupter disc and the flow control valve seal, providing sufficient flow for the flushing cycle. The radial slits in the barrier seal open as the flow exits and particulate matter is flushed away from the stem as it retracts.

In current irrigation technology the improvements described in the above paragraphs apply only to sprinklers with solenoid-operated pilot valves. These methods do not apply to current hydraulically operated sprinklers. In order to extend the methodology to include hydraulically controlled sprinklers, a hydraulic pilot valve has been made a feature of the invention. The hydraulic pilot valve differs from a solenoid-operated pilot valve only in energy source and application. Hydraulic pressure is applied to a spring-loaded plunger which lifts a poppet off of its seat to vent the bonnet chamber. The inlet and outlet ports are so arranged that the inlet port leads to the top of the poppet, so that bonnet chamber pressure holds the poppet onto its seat. The outlet port leads to the under side of the poppet.

The use of a normally closed hydraulic pilot valve in place of the solenoid-operated pilot valve of an electric sprinkler produces a hydraulically controlled sprinkler to which all the aforementioned improvements apply. Moreover, there are additional advantages inherent in this approach to hydraulic control:

1. Current hydraulic valves are normally open, so that hydraulic sprinklers turn on, or remain on, when control pressure is lost. With the use of a normally closed hydraulic pilot valve, the sprinklers will turn off or remain off when control pressure is lost—a preferable situation.
2. Again, in current hydraulic sprinklers, the case pressure cannot be individually regulated, as can be done with electric sprinklers. With a hydraulic sprinkler that uses a normally closed hydraulic pilot valve and an electric-style flow control valve, case pressure can be individually regulated.

Items 1 and 2 above are incidental advantages that accrue from the use of a hydraulic pilot valve, whereas its primary use in this invention is to extend the advantages of the slow opening, slow closing, stem-flushing valve to hydraulically controlled systems.

Another feature of the invention is its ability to be used in part, improving only specific individual functions of an irrigation system, such as reducing the closing rate or opening rate of a supply valve, producing a stem-flushing cycle, providing an improved stem seal, or creating a safer, more flexible hydraulic control system. Further, these improvements may be used with separate flow control valves or valve-in-head sprinklers, or all of the improvements may be used in combination.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 11 is a cross-sectional view taken along lines 11—11 of FIG. 10.

FIG. 18 is a cross-sectional view taken along lines 18—18 of FIG. 10.

BEST MODE FOR CARRYING OUT THE INVENTION

Figure 1:
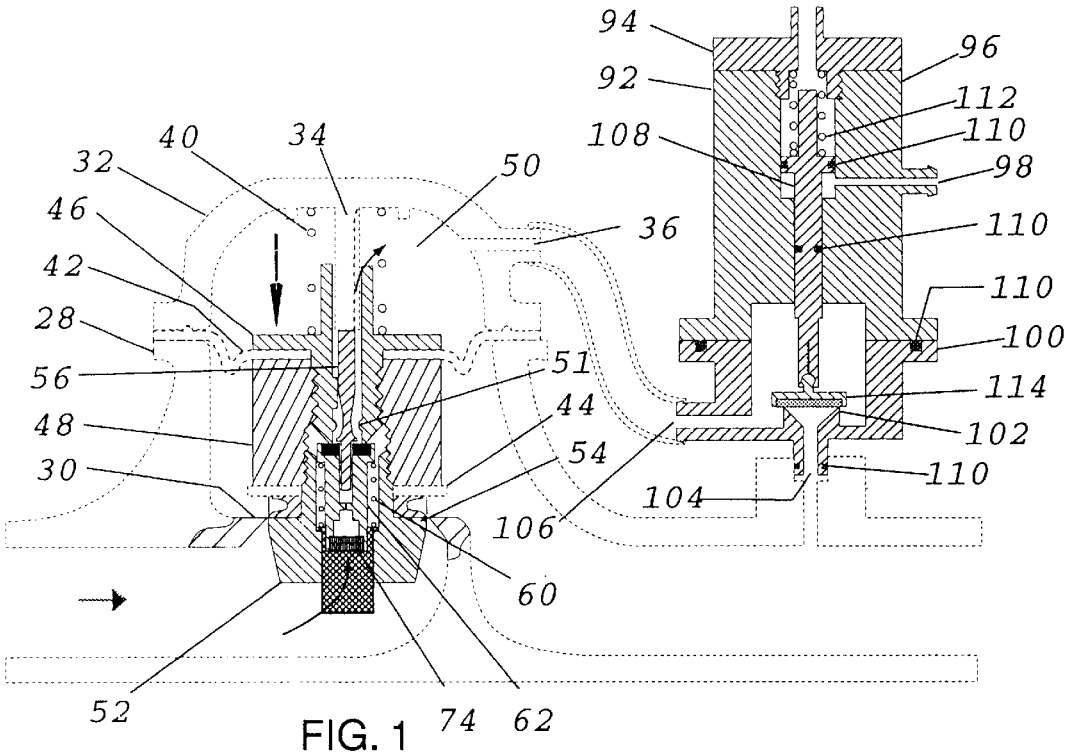
FIG. 1 is a cross-sectional view of the preferred embodiment in a separate flow control valve incorporating the hydraulic pilot valve. The view shows the valve closing, at the point of flow interruption, when the sprinkler stems begin to retract in preparation for flushing.

The best mode for carrying out the invention is presented in terms of a preferred embodiment. It should be noted that the invention covers an improvement in existing art for specific functional components in various types of pop-up sprinkler systems. Thus, the invention may be used as separate elements, or in any combination, as described.

The preferred embodiment, as shown in FIGS. 1–16, is comprised of improvements in sprinklers having a sprinkler case 20 with a bearing guide 80, a pop-up stem 22, a pop-up seal 24, and a retracting spring 26, and in flow control valves having a bonnet 32, a pilot flow exit port 36, a piston 48, and piston guide 46 with an internal flow passage to accommodate continuous pilot flow through the bonnet chamber when the valve is open. Prior art elements are shown in broken lines while new items are shown in solid lines. A sprinkler with an integral flow control valve in its base is referred to as a valve-in-head sprinkler. Note that the flow control valve seats 30 of both the sprinkler case 20 and the separate valve are modified to have a sharp-edged orifice profile, shown in solid lines.

Figure 3:
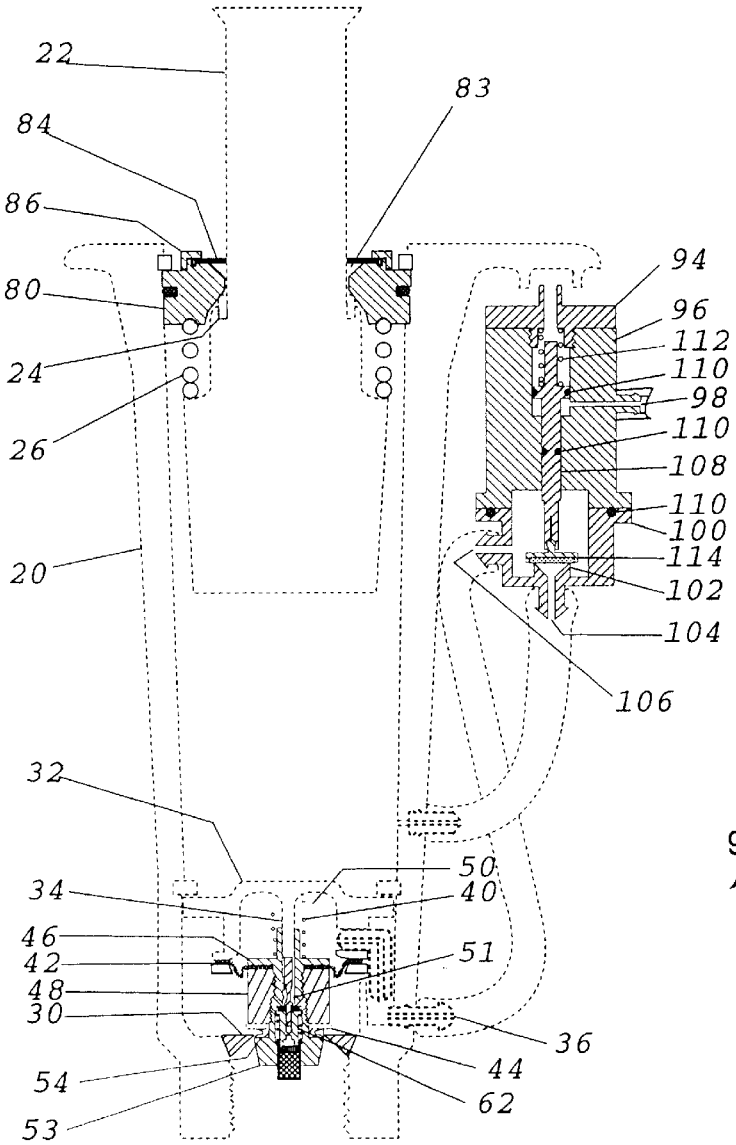
FIG. 3 is a cross-sectional view of the preferred embodiment integral with a valve-in-head irrigation sprinkler with a hydraulic pilot valve.
Figure 4:
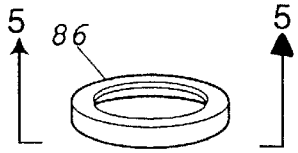
FIG. 4 is a partial isometric view of the seal retainer completely removed from the invention for clarity.
Figure 5:
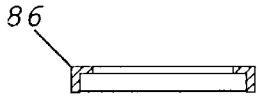
FIG. 5 is a cross-sectional view taken along lines 5—5 of FIG. 4.
Figure 6:
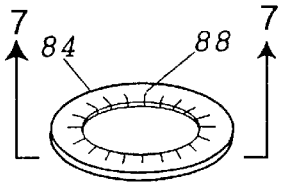
FIG. 6 is a partial isometric view of the barrier seal completely removed from the invention for clarity.
Figure 7:
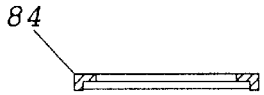
FIG. 7 is a cross-sectional view taken along lines 7—7 of FIG. 6.
Figure 8:
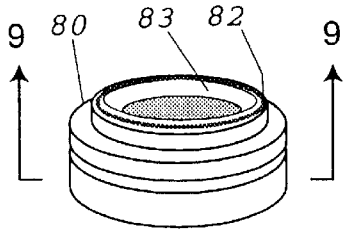
FIG. 8 is a partial isometric view of the bearing guide completely removed from the invention for clarity.
Figure 9:
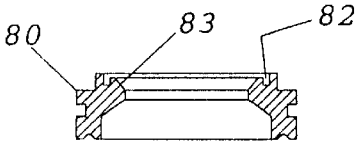
FIG. 9 is a cross-sectional view taken along lines 9—9 of FIG. 8.

FIG. 3 depicts the valve-in-head embodiment, and the other figures illustrate the invention in separate flow control valves. The prior art elements include a valve body 28, a bonnet 32 with a guide stem 34 and a pilot flow exit port 36. Further, the valve has a piston 48, a piston spring 40, a flow control valve diaphragm 42 extending between the bonnet 32 and the piston 48, and a valve seal 44, which is contiguous with both the piston 48 and the modified valve seat 30 when is the valve is closed.

The improvements to the valve-in-head sprinkler are as follows:

1. The addition of dual flowpath means for pilot flow to slow the closing stroke,
2. The addition of an interrupter disc 54 and a modified valve seat 30 to produce a flushing cycle,
3. The use of a barrier seal 84 on the bearing guide 80 to prevent the sprinkler pop-up stem 22 from seizing while fully extended,
4. The introduction of a variable pilot flow orifice to control pilot flow into the bonnet chamber 50 in order to slow the opening rate of the valve,
5. The use of a hydraulic pilot valve 92 to make all of the above improvements applicable to hydraulically actuated sprinklers.

Improvements No. 1, 2, 4, and 5 above apply also to separate flow control valves.

The dual flowpath means, consists of a primary pilot flowpath, a secondary pilot flowpath, and a pilot flow diverter valve. The pilot flow diverter valve with internal restricted flowpath, functions to retard the final piston closing rate to serve two purposes: first, to facilitate flushing, and second, to eliminate upstream supply line pressure surges.

The pilot flow diverter valve, as best illustrated in FIGS. 10 and 13–16, is comprised of a modified piston guide 46 with an axial flowpath and a diverter valve seat 47, a metering push-rod 56, a poppet compression spring 60, and a poppet assembly which includes a poppet body 62 with integral orifice 68*b*, a micro-orifice ring 72, a filter 74, and a poppet seal 70.

The modified piston guide 46, with its diverter valve seat 47, is slidably disposed upon the bonnet guide stem 34 inside the piston spring 40, and functions together with the metering push-rod 56, the poppet compression spring 60, and the poppet assembly to form a pilot flow diverter valve.

At the same time, a throat 51 in the axial flowpath of the modified piston guide 46 functions together with a tapered section of the metering push-rod to form a variable pilot flow orifice at the inlet to a bonnet chamber 50.

The modified piston guide has internal guide ribs 49, as shown in FIG. 18 and FIGS. 13–16, which hold the metering push-rod concentric in its axial flowpath. The passage narrows near the lower end, forming a throat 51, which meters flow around the tapered portion of the metering push-rod. The lower section fits loosely in a flowpath 68*a* of the poppet body 62 such that it causes negligible flow restriction but serves to align the metering push-rod with the poppet body. A flange 58 separates the two sections of the push-rod.

Figures 10, 12:
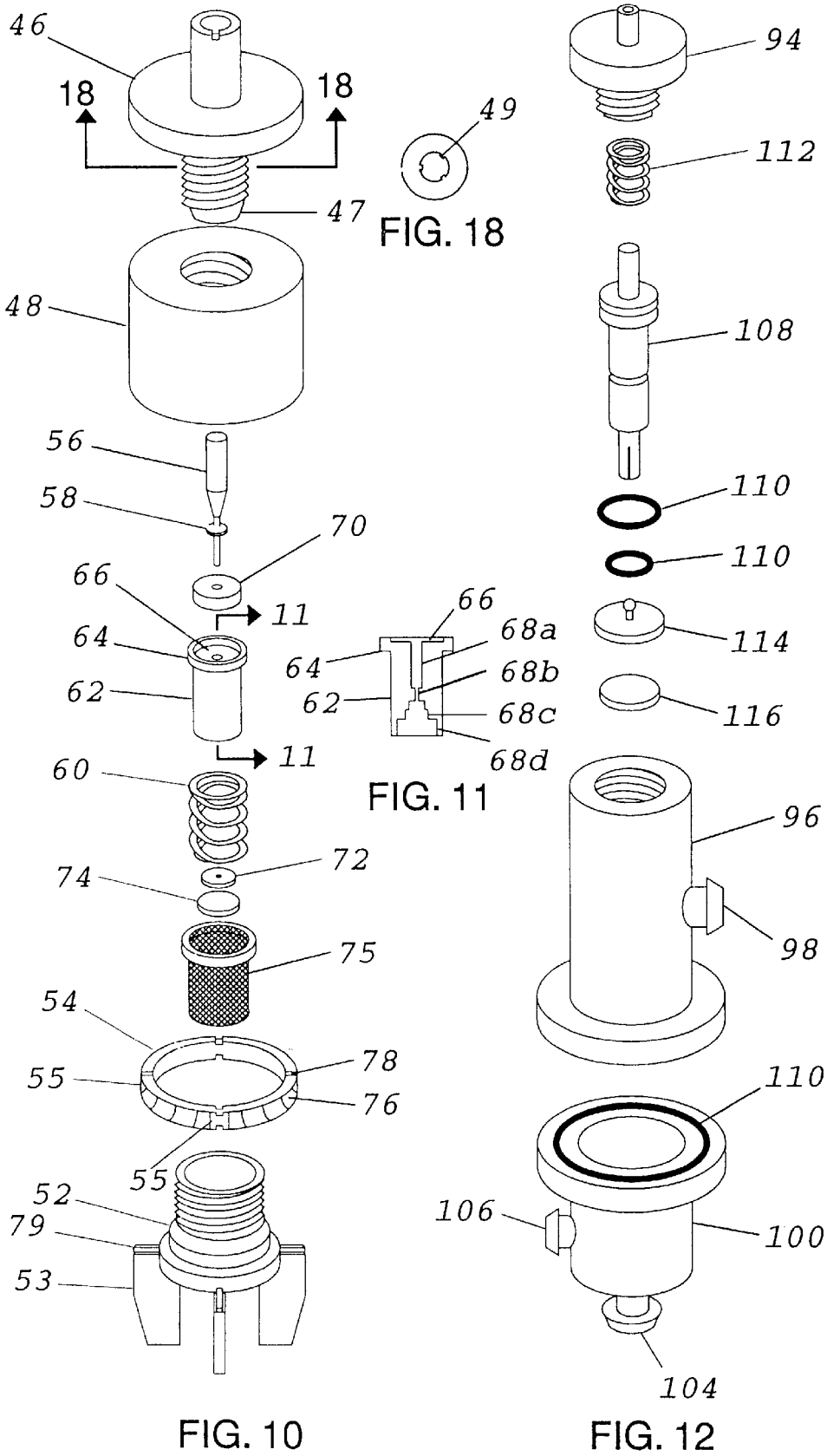
FIG. 10 is an exploded view of the dual flowpath and flow interrupting elements.
FIG. 12 is an exploded view of the hydraulic pilot valve.

The piston 38 is threadably engaged to the modified piston guide 46 as illustrated in FIG. 10. A flow control valve diaphragm 42 is sandwiched between the piston 48 and the modified piston guide 46 on its inside diameter, and between the bonnet 32 and valve body 28 on its outside diameter, forming a bonnet chamber 50 inside the bonnet 32. A tapered four-ribbed disc retainer 52 is threadably attached to the piston 48 on an end opposite the modified piston guide 46, and serves to retain the poppet assembly and poppet spring, as well as the interrupter disc 54 and valve seal 44.

The poppet assembly is slidably disposed within the disc retainer 52 and held under the influence of the poppet compression spring 60. The poppet body 62 has an outwardly extending shoulder 64 located on the top for retaining the compression spring 60. The top section also includes a recess 66 which retains poppet seal 70, and an axial flow passage 68*a* through to the lower end. The lower section contains the micro-orifice ring 72 retained in an orifice recess 68*c*, and the filter 74, retained in a filter recess 68*d*. In the middle is a micro-orifice 68*b* which is integral with the poppet body, as shown in FIG. 11. The filter 74 constructed of sintered metal or open pore foam plastic protects the micro-orifices from blockage by sand or other particulate matter.

The configuration of two orifices in series is shown in FIGS. 10 and 11 for simplicity to illustrate the principle of restricting flow by means of a plurality of orifices in series. This gives the required flow restriction with the use of larger orifices than would be necessary if a single orifice were used. While a larger orifice is preferable to avoid clogging, the number of orifices to be used is optional, based on design preference.

The variable pilot flow orifice functions within the flow control valve during the opening stroke, as shown in FIGS. 13–16, such that when the pressure begins to be vented from the bonnet chamber 50 the piston 48 moves rapidly to the point where the interrupter disc 54 exits the modified valve seat orifice 31. At this point the pilot flow diverter valve opens, and the small end of the tapered metering section of the push-rod allows adequate pilot flow into the bonnet chamber to retard the initial opening rate. As the opening stroke proceeds the larger part of the taper moves into the throat of the piston guide, decreasing the flow into the bonnet chamber so that the valve can open fully at a normal rate.

Figure 13:
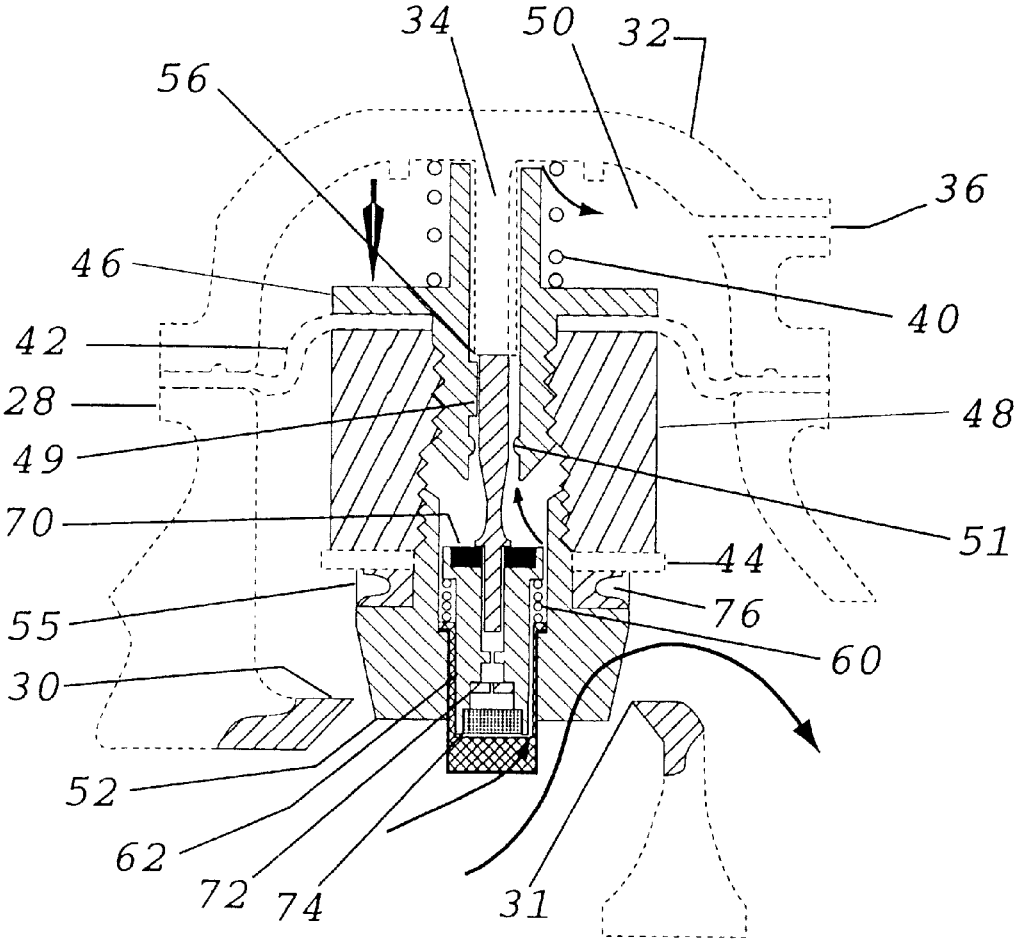
FIG. 13 is a cross-sectional view of the preferred embodiment with the valve fully open.
Figure 14:
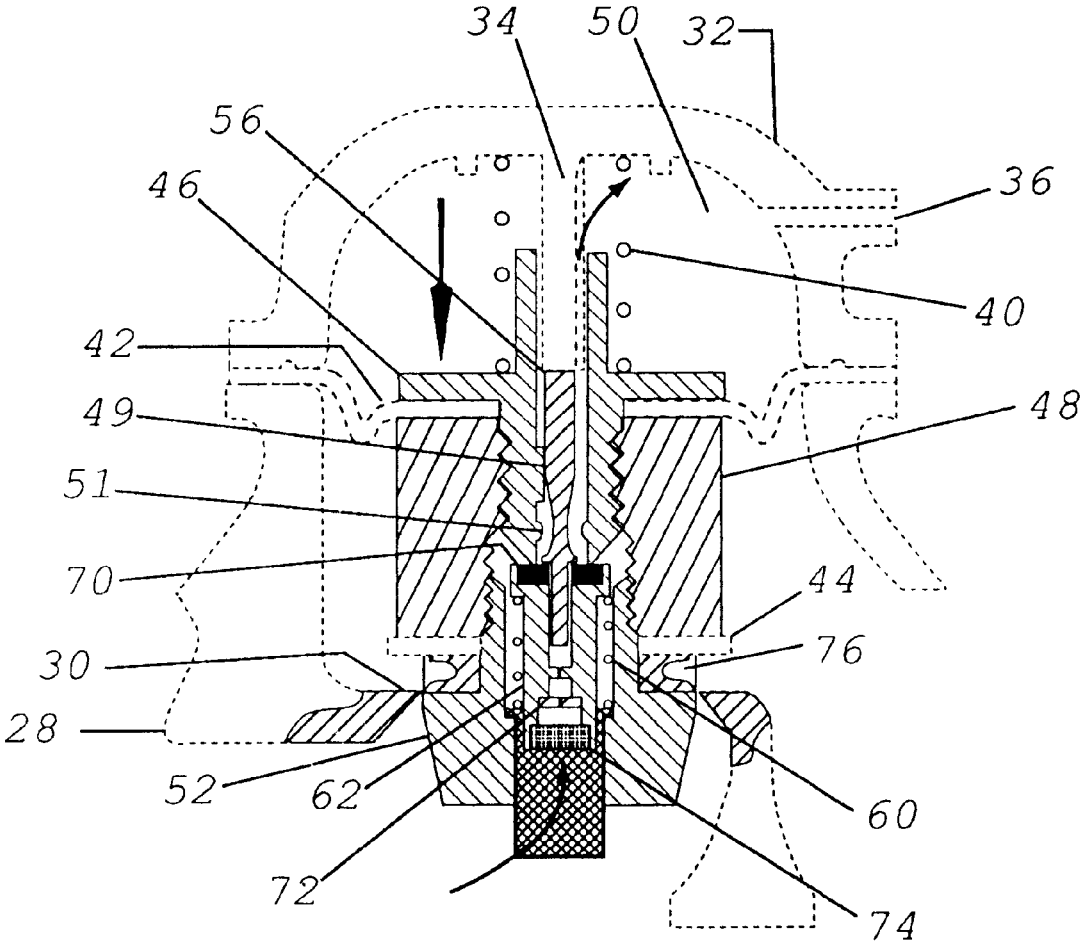
FIG. 14 is a cross-sectional view of the preferred embodiment with the valve in the interrupted flow position.

An opening movement of the piston is called an opening stroke, and a closing movement is called a closing stroke. The pilot flow diverter valve carries out its function during the closing stroke. When the flow control valve is in the process of closing, the bonnet chamber 50 is pressurized in two distinct steps, as illustrated in FIGS. 13–16. In the first step, as shown in FIG. 13, the flowpath is around the poppet body 62 and through the annular space between the tapered section of the metering push-rod 56 and the throat 51 of the piston guide 46. This annular space is the variable pilot flow orifice. This is the primary flowpath, which remains open until the interrupter disc 54 approaches the modified valve seat 30. At this point the pilot flow diverter valve closes, as shown in FIG. 14. This seals off the primary flowpath and initiates the second step, in which pilot flow is directed through the secondary flowpath, that is, through the filter 74 and micro orifices 72 and 68*b* within the poppet assembly. The closing stroke now proceeds slowly through the flushing cycle to final shut-off.

The mechanism which produces the flushing cycle involves the interrupter disc 54, a disc retainer 52, and a modified valve seat orifice 31. The interrupter disc 54 and the flow control valve seal 44 are compressed between the piston 48 and the disc retainer 52. The flow control valve seal 44 provides a leak-proof closure which shuts off hydraulic flow when the flow control valve seal is contiguous with the valve seat 30. The interrupter disc 54 interfaces with the disc retainer 52 with interlocking radial keys 79 and radial slots 78, as shown in FIG. 10, for alignment of disc retainer ribs 53 with interrupter disc ribs 55, and for positive retainment.

The interrupter disc 54 has a cylindrical inside diameter, a concave outer surface, and flat, annular end surfaces with radial slots 78 as mentioned above. One of the end surfaces has an outside diameter which slidably fits in the valve seat orifice 31, while the other is slightly smaller, and there are longitudinal guide ribs 55 between the two end surfaces to facilitate a smooth sliding action as it moves through the sharp-edged valve seat orifice. The surface with the sliding fit diameter must be at the bottom if flushing is to occur. The other surface has a smaller outside diameter, and normally serves to hold the valve seal 44 in place.

Figure 15:
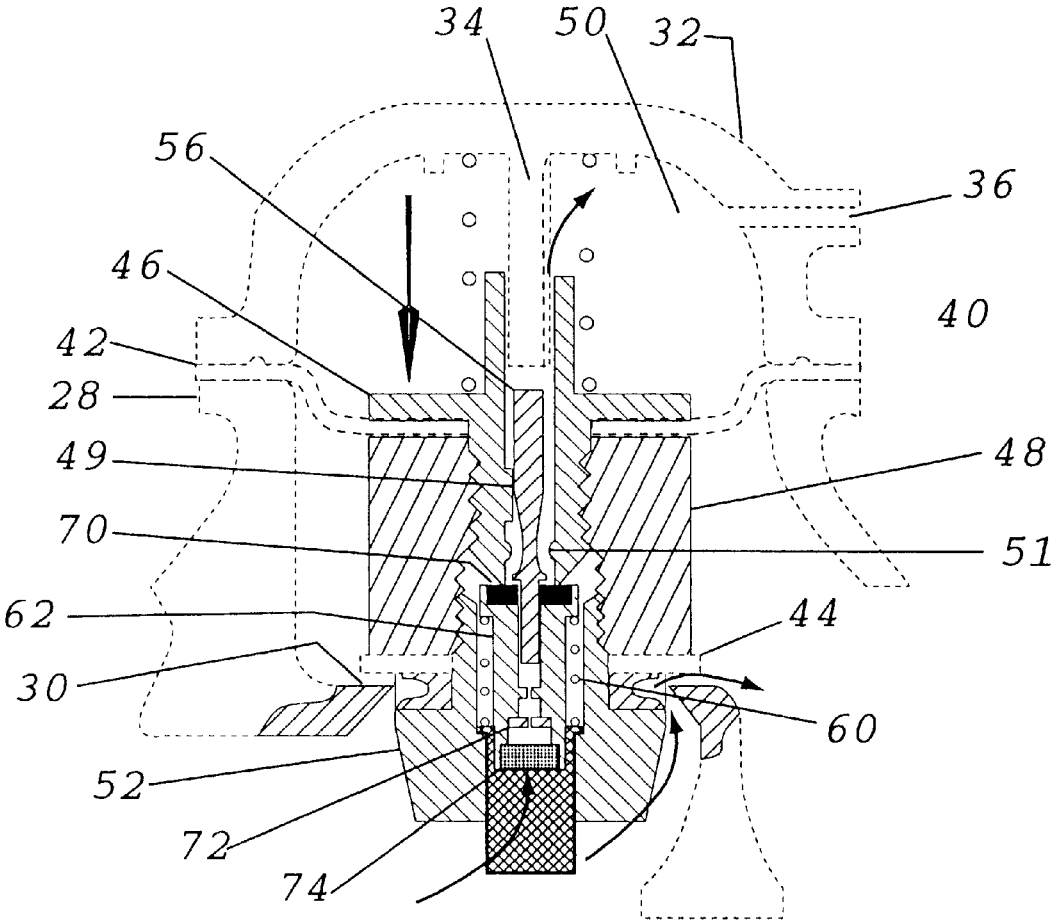
FIG. 15 is a cross-sectional view of the preferred embodiment with the valve in the stem-flushing position.
Figure 16:
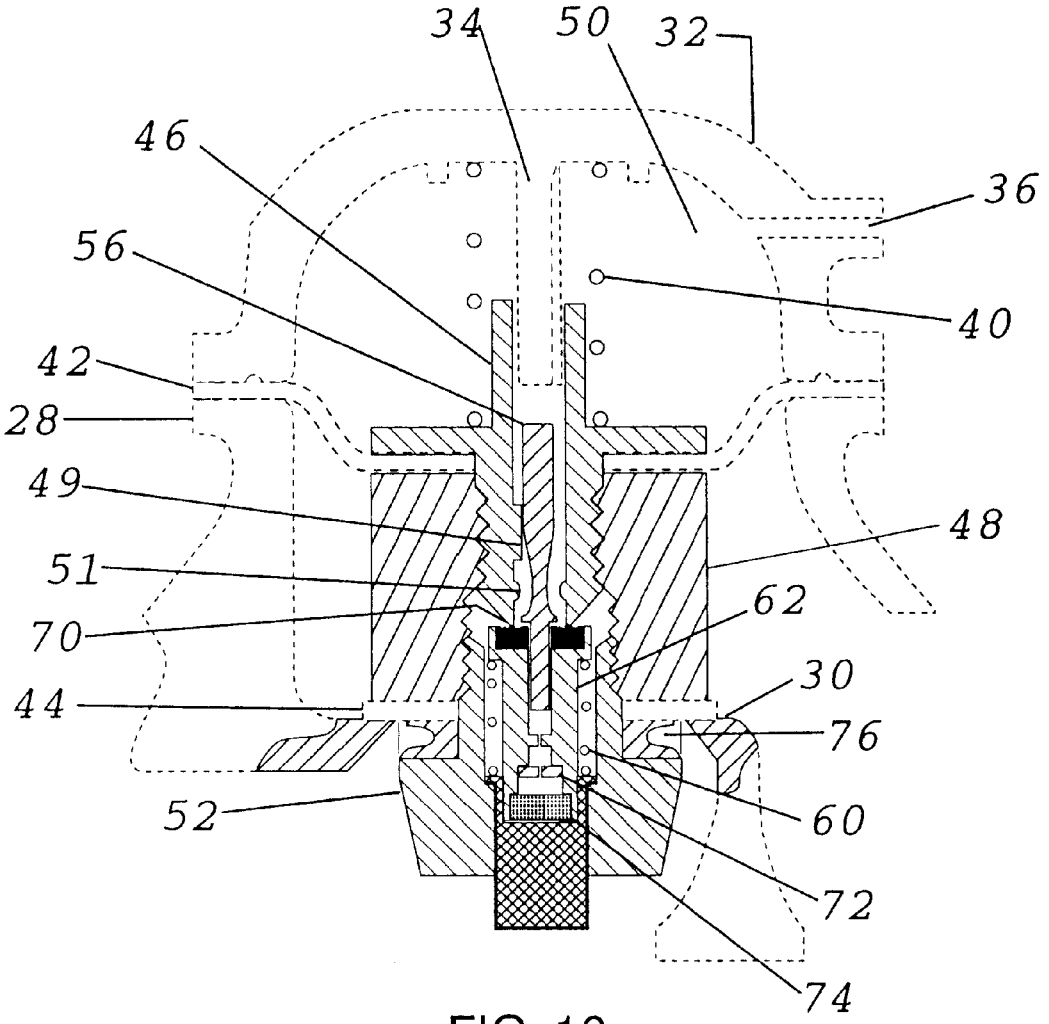
FIG. 16 is a cross-sectional view of the preferred embodiment with the valve fully closed.

The cross-sectional profile of the valve seat 30 as shown in FIGS. 1,2, and 13–16 is modified to have a sharp edge at its inside diameter to accommodate a flowpath when it interfaces with the concavity of the interrupter disc. When the flow control valve is closing and the lower edge of the interrupter disc 54 first enters the seat 30, as shown in FIG. 14, the water flow is momentarily blocked due to the close fit therebetween. This causes the sprinkler pop-up stem(s) 22 to retract in preparation for flushing. As the interrupter disc continues to move slowly through the seat orifice the concavity in its outer surface creates a flowpath for flushing flow, as shown in FIG. 15. This brief flushing cycle, which ends when the valve seal 44 seats itself, may be implemented with either the valve-in-head sprinkler or a separate flow control valve.

Flushing may be omitted by inverting the interrupter disc so that the smaller diameter is at the bottom. In this configuration the flow is restricted but not interrupted. This flow restriction helps to prevent pressure surges during the initial stages of valve opening.

The flushing cycle, however, will be of no avail if the pop-up stem cannot move downward enough to unseat the pop-up seal. For this reason sealing means are utilized to prevent seizing of the pop-up stem 22 to the bearing guide 80 while in the fully extended position due to intrusion of foreign matter therebetween. These sealing means, depicted in FIGS. 3–9, are embodied in a barrier seal 84 attached to the bearing guide 80, and closely surrounding the pop-up stem 22. The bearing guide is retained within the upper end of the sprinkler case 20 contiguous with the retracting spring 26 and the pop-up seal 24. The bearing guide has a seal cavity 82 in its upper surface. A resilient barrier seal 84 is disposed within the bearing guide seal cavity 82 and closely surrounds the pop-up stem 22. A seal retainer 86 is pressed onto the bearing guide 80 and holds the barrier seal 84 in place. The close fit of the barrier seal around the pop-up stem prevents sand or other particulate matter from lodging between the stem 22 and the bearing guide 80.

When flow into the sprinkler is interrupted in preparation for flushing, and the pop-up stem 22 begins to retract, the barrier seal 84 flexes downward into a chamfered corner 83 between the bearing guide and the stem, allowing enough movement to unseat the pop-up seal 24. This opens a flow passage so that flushing can begin. Radial slits 88 in the inner circumference of the seal allow it to open to accommodate adequate flushing flow as the stem retracts.

Figure 2:
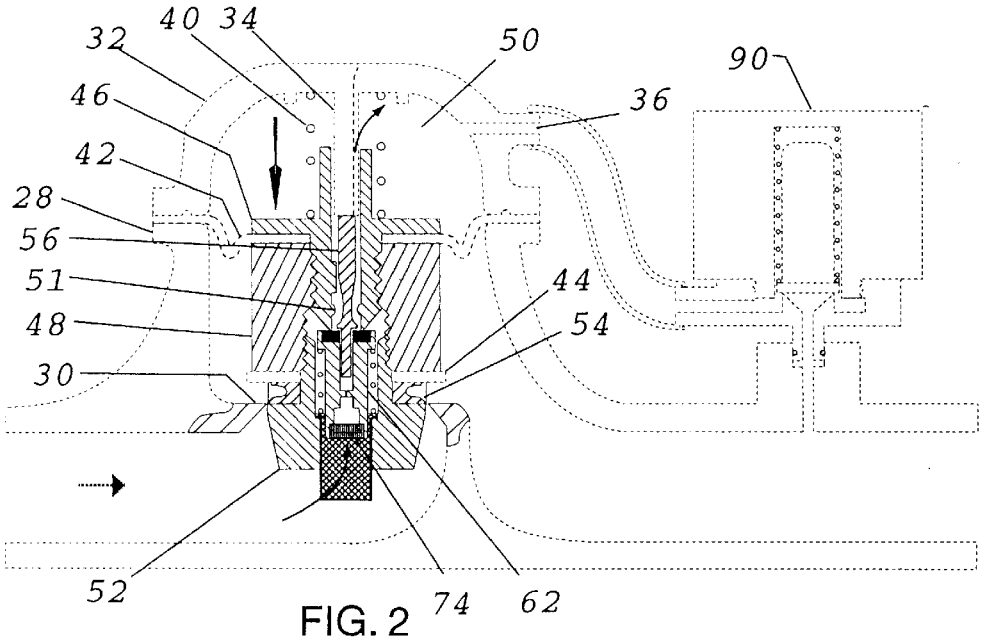
FIG. 2 is a cross-sectional view of the preferred embodiment in a separate flow control valve incorporating an electric solenoid valve. Again, the view shows the valve closing, at the point of flow interruption, just before stem flushing is initiated.

Electrically operated valves for sprinklers, whether in valve-in-head sprinklers, as shown in FIG. 3, or as separate valves, as illustrated in FIGS. 1 and 2, use a direct acting pilot valve for actuation. The direct acting pilot valve is in the form of an electric solenoid valve 90 and is shown dotted in FIG. 2 and solid in FIG. 17 (prior art).

This type of solenoid valve 90 is well known in the art, and operates from a normally closed position. Electrically energizing the solenoid valve 90 creates an electromagnetic field within a wire-wound coil. This action draws a spring-loaded plunger inside the coil, lifting a poppet from its seat to permit flow through the valve. Opening the solenoid valve 90 de-pressurizes the bonnet chamber 50 allowing the piston 48 to move upward away from the seat 30, opening the flow control valve.

On the other hand, hydraulic flow control valves which are presently in common use have no pilot valves on or near the valve, instead, valve closing is accomplished by pressurizing the bonnet chamber 50 through a hydraulic line from a remote solenoid. Opening is achieved by venting bonnet chamber pressure through the same line. Because of problems with this type of approach, as discussed previously, the invention employs direct actuating pilot valve means in the form of a normally closed, spring-loaded, self-aligning poppet, hydraulic pilot valve 92, as shown in FIGS. 1, 3, and 12. The pilot valve 92 is actuated by hydraulic energy in lieu of electrical energy as used by the solenoid valve.

The normally closed hydraulic pilot valve 92, as shown in FIGS. 1, 3, and 12, is constructed with a pilot valve top 94 vented to atmosphere, screwed on to a pilot valve body 96. The body 96 contains a chamber of three different diameters, continuing through its entire length, and a control pressure line port 98 in communication with the inside of the upper chamber. A pilot valve bottom 100 is attached to the body 96 and includes a valve seat 102, with an inlet 106 and an outlet 104 communicating with the valve seat 102, one on either side. A plunger 108 is slidably disposed within the body chamber with a pair of o-rings 110 for sealing. A plunger spring 112 is positioned between the plunger 108 and the valve top 94 urging the plunger away from the top and toward the valve seat 102. A pilot valve poppet 114, retaining a seal 116, is attached to the plunger 108 such that when hydraulic pressure is applied through the pressure port 98 the plunger moves against the plunger spring 112 and lifts the attached pilot valve poppet 114 from the valve seat 102, permitting bonnet chamber pressure to be vented, thus allowing the valve to open.

To recap the normally closed hydraulic pilot valve's functional operation, the normally closed hydraulic valve 92 has a normally closed, spring-loaded, self-aligning pilot valve poppet 114 which seals off the downstream pilot flow path when the pilot valve control pressure port 98 is not pressurized, causing the bonnet chamber 50 to be pressurized and the valve held closed. To open the normally closed hydraulic pilot valve 92, control pressure must be applied through the control pressure port 98. This lifts the plunger 108 and poppet 114, and vents the pressure from the bonnet chamber 50, enabling the control valve to open.

Figure 17:
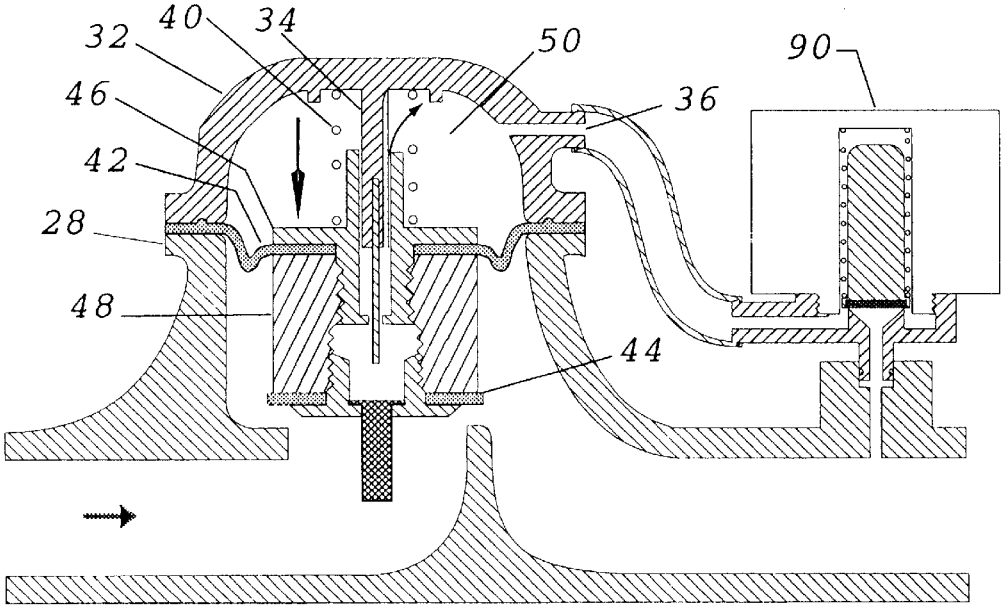
PRIOR ART FIG. 17
FIG. 17 is a cross-sectional view of the prior art with an electric solenoid pilot valve.

In order to fully understand the improvement to the prior art control valve, FIG. 17 illustrates the valve as presently in use and its function is as follows: The control valve is opened by energizing the solenoid, which lifts the poppet and de-pressurizes the bonnet chamber, allowing the piston to move upward, opening the flow control valve.

The rate at which the valve opens is determined by the net flow out of the bonnet chamber, that is, the flow out minus the flow in. The flow out is initially very rapid because of a high exit pressure differential, while the flow in is slow because of a low inlet pressure-differential. This causes a rapid initial opening response, which can produce potentially destructive pressure surges in downstream piping and sprinklers.

The introduction of the variable orifice at the inlet to the bonnet chamber 50 makes it possible to increase the inlet flow at the beginning of the opening stroke. By this means we control the net flow out of the bonnet chamber 50 during the critical part of the opening stroke, thus slowing the initial opening speed and avoiding destructive pressure surges.

The smaller end of the tapered section of the metering push-rod 56 is positioned in the throat 51 of the modified piston guide 46 at the beginning of the opening stroke to allow maximum inlet flow. As the opening stroke progresses and the flow out of the bonnet chamber 50 decreases, a reduction in inlet flow is required. This is accomplished when the larger end of the tapered section of the metering push-rod 56 moves into the throat 51 of the modified piston guide 46, reducing the flow area and thus decreasing the inlet flow.

The existing flow control valve is closed by de-energizing the solenoid, which effectively closes the outlet of the bonnet chamber 50. Pilot flow enters the chamber 50 through the inlet orifice, the annular space around the metering pin, and forces the piston 48 and seal 44 down onto the seat 30.

The rate at which the piston moves during the closing stroke is proportional to the flow into the bonnet chamber 50. The flow increases with the differential across the orifice, and the pressure differential increases as the valve closes. Therefore, the closing rate is highest just before shut-off.

At a given supply pressure, the size of the inlet orifice determines the overall closing rate. Too small an orifice causes an unacceptably slow closing rate, while too large an orifice causes a very fast closing rate, which can produce destructive supply line pressure surges, (or in the extreme, failure of the valve to open). Current technology seeks a workable compromise between the two. The result is that many valves produce undesirable closing pressure surges in upstream supply lines, depending on the length of the line and the velocity of the flow.

The introduction of the pilot flow diverter valve with its restricted internal flowpath permits slowing of the closing stroke at the critical final stage just before shut-off, which eliminates upstream pressure surges and also provides time for the flushing cycle to occur.

Although the diverter valve increases the rapid movement of the piston at the very beginning of the opening stroke, the interposition of the interrupter disc prevents any downstream pressure surges from occurring as a result of this.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

I claim:

1. An improved pop-up irrigation sprinkler of the type having a basically cylindrical case with a bearing guide, and a pop-up stem slidably disposed therein, a pop-up seal, a retracting spring, and a flow control valve whose operation consists of an opening stroke and a closing stroke actuated by a direct acting pilot valve, being of the type having a bonnet, a pilot flow exit port, and a piston with an internal flow passage to accommodate continuous pilot flow through the bonnet chamber when the valve is open, also a piston spring, sealing means positioned between the bonnet and the piston, and a valve seal contiguously engageable between the piston and the valve seat, wherein the improvement comprises:

a) means for producing in the flow control valve a closing rate sufficiently slow near the end of a closing stroke to eliminate potentially destructive supply line pressure surges upstream of the valve due to valve closure, and to facilitate flow interruption and stem flushing prior to final closure, b) flow interrupting means within the flow control valve for producing a brief flushing cycle to wash away debris between the sprinkler pop-up stem and bearing guide, and c) sprinkler seal means on the bearing guide such as to provide a vertically flexible barrier between intruding foreign matter and the interface between the pop-up stem and the bearing guide.

2. The irrigation sprinkler as recited in claim 1 wherein said sealing means comprises a diaphragm extending between the bonnet and the piston.

3. The irrigation sprinkler as recited in claim 1 wherein said sealing means comprises a pressure-activated seal positioned between the bonnet and the piston.

4. The irrigation sprinkler as recited in claim 1 wherein said means for producing comprising dual flowpath means for pilot flow within the flow control valve for retarding piston final closing rate to facilitate flushing and elimination of supply line pressure surges.

5. The irrigation sprinkler as recited in claim 4 wherein said dual flowpath means for pilot flow comprises:

a) a primary pilot flowpath metered for faster closure of the flow control valve, b) a secondary pilot flowpath metered for slower closure of the flow control valve, and c) a pilot flow diverter valve which automatically closes the primary pilot flowpath near the end of the closing stroke, diverting the pilot flow through the secondary pilot flowpath in order to slow the final closing rate of the flow control valve.

6. The irrigation sprinkler as recited in claim 4 wherein said dual flowpath means for pilot flow further comprises:

a) a piston guide having an axial flowpath with a downward-facing valve seat, b) a piston interfacing with said piston guide, c) a multi-ribbed disc retainer attached to said piston on an end opposite the piston guide, d) poppet means slidably disposed within said disc retainer, e) said flow interrupting means having an interrupter disc along with the valve seal, contiguously compressed between said piston and said disc retainer, the valve seal providing a leak-proof closure, shutting off the flow of water when the valve seal is interfaced with the valve seat, f) a metering push-rod having an upper section slidably disposed within the internal flow passage of the piston guide so as to meter pilot flow, a lower section loosely fitting in the internal flow passage of the poppet means, and a shoulder between the two sections suitable to push the poppet means off its seat, and g) said poppet means held under the influence of a poppet compression spring, having an annular seal at an upper end, an internal flow passage, and flow restricting means within, and a filter at the lower end, such that when the bonnet chamber is pressurized by closing the pilot flow exit port, the flow control valve closes in two distinct steps:

(1) a rapid movement of the piston occurs during the first part of the stroke when a primary pilot flowpath is formed around the poppet means and through the annular space between the upper section of the metering push rod and the axial flowpath of the piston guide, allowing rapid flow of water into the bonnet chamber, and (2) a slow movement occurs at the end of the stroke when the primary pilot flow path is sealed by the poppet means, allowing a smaller flow through said flow restriction means within said poppet means.

7. The irrigation sprinkler as recited in claim 6 wherein said poppet means further comprises a poppet assembly having a poppet body with an upper end and a lower end, with the upper end having compression spring retaining means, a poppet seal held in seal retaining means, and an internal flowpath connecting with the lower end containing flow restricting means, and a filter held in filter retaining means.

8. The irrigation sprinkler as recited in claim 1, further comprising a variable pilot flow orifice at the inlet to the bonnet chamber for producing in the flow control valve an opening rate which is sufficiently slow early in the opening stroke to eliminate potentially destructive pressure surges in lines or system components downstream of the valve.

9. The irrigation sprinkler as recited in claim 8 wherein said variable pilot flow orifice consists of a rod having a tapered metering section slidably disposed within a narrowed area of the pilot flowpath and keyed to the stroking of the piston at the inlet of the bonnet chamber for the purpose of slowing the initial opening rate of the flow control valve, while assuring an adequate opening rate for the rest of the opening stroke.

10. The irrigation sprinkler as recited in claim 1 wherein said flow interrupting means comprises a interrupter disc as a flowpath, wherein said interrupter disc further having a concave outer surface with alignment ribs, and an outside diameter at the bottom edge sized to slide through the flow control valve seat with a slip fit, when said valve is closing and the piston is descending toward the seat, as the interrupter disc first enters the seat, as travel continues, the concavity creates a flowpath until the valve seal is contiguous with the seat, thereby forming a brief flushing cycle of restricted flow during valve closure.

11. The irrigation sprinkler as recited in claim 1, wherein said sprinkler seal means further comprises:

a) The bearing guide sealably retained within an upper end of the sprinkler case contiguous with the retracting spring and pop-up seal, b) barrier seal retaining means on said bearing guide, and c) a resilient barrier seal attached to said bearing guide by said barrier seal retaining means, closely surrounding the pop-up stem, and maintaining a close fit so as to exclude foreign matter from the interface between the pop-up stem and the bearing guide, and yet able to flex downward with the pop-up stem enough to allow the pop-up seal to open and thus create a flowpath for flushing, said resilient barrier seal having slits in its inner circumference such as to permit sufficient flexibility to accommodate adequate flushing flow.

12. The irrigation sprinkler as recited in claim 1 said direct acting pilot valve comprises a hydraulically actuated, direct acting, normally closed pilot valve, hydraulically connected to the flow control valve for opening and closing said flow control valve.

13. The irrigation sprinkler as recited in claim 12 wherein said hydraulically actuated, direct acting, normally closed pilot valve further comprising:

a) a pilot valve top, vented to atmosphere, b) a pilot valve body with a chamber therethrough, attached to the top, having a control pressure line port in communication with the chamber, c) a pilot valve bottom attached to the body, having a valve seat, an inlet and an outlet, with the outlet communicating with the valve seat, d) a plunger slidably disposed within the body chamber, e) a pilot valve plunger spring positioned between the plunger and the valve top, urging the plunger away from the top towards the valve seat, and f) a poppet attached to the plunger such that when hydraulic pressure is applied through the pressure line port, the plunger is moved against the spring force toward the valve top, lifting the attached poppet from the valve seat, permitting bonnet chamber pressure to be vented, enabling the flow control valve to open.

14. An improved pop-up irritation sprinkler of the type having a cylindrical case with a bearing guide, a pop-up stem slidably disposed therein, a pop-up seal, and a retracting spring, wherein the improvement comprises sprinkler seal means on the bearing guide such as to provide a vertically flexible barrier between intruding foreign matter and the interface between the pop-up stem and the bearing guide, wherein said sprinkler seal means further comprises:

a) the bearing guide sealably retained within an upper end of the sprinkler case contiguous with the retracting spring and the pop-up seal, b) barrier seal retaining means on said bearing guide, and c) a resilient barrier seal attached to said bearing guide by said barrier seal retaining means, closely surrounding the pop-up stem and maintaining a close fit so as to exclude foreign matter from the interface between the pop-up stem and the bearing guide, and yet able to flex downward with the pop-up stem enough to allow the pop-up seal to open and thus create a flowpath for flushing, said resilient barrier seal having radial slits in its inner circumference to permit sufficient flexibility to accommodate adequate flushing flow.

15. An improved separate irrigation flow control valve of the type having a body, a valve seat, a bonnet, a pilot flow exit port, and a piston, each with an internal flow passage to accommodate continuous pilot flow through the bonnet chamber when the valve is open, a piston spring, sealing means positioned between the bonnet and the piston, and a valve seal contiguously engageable between the piston and the valve seat, wherein the improvement comprises:

a) means for producing a closing rate sufficiently slow near the end of the closing stroke to eliminate potentially destructive supply line pressure surges upstream of the valve, and facilitate flow interruption prior to final closure, and b) flow interrupting means for producing a brief flushing cycle to wash away debris from between sprinkler stems and bearing guides.

16. The flow control valve as recited in claim 15 wherein said sealing means comprises a diaphragm extending between the bonnet and the piston.

17. The flow control valve as recited in claim 15 wherein said sealing means comprises a pressure-activated seal positioned between the bonnet and the piston.

18. The flow control valve as recited in claim 15 wherein said means for producing comprising a dual flowpath means for pilot flow for retarding piston final closing rate to facilitate sprinkler stem flushing and elimination of supply line pressure surges.

19. The flow control valve as recited in claim 18 wherein said dual flowpath means for pilot flow comprises:

a) a primary pilot flowpath metered for faster closure of the flow control valve, b) a secondary pilot flowpath metered for slower closure of the flow control valve, and c) a pilot flow diverter valve which automatically closes the primary pilot flowpath near the end of the closing stroke, diverting the pilot flow through the secondary pilot flowpath in order to slow the final closing rate of the flow control valve.

20. The flow control valve as recited in claim 18 wherein said dual pilot flowpath means further comprises:

a) a piston guide having an axial flowpath with a downward-facing valve seat, b) a piston interfacing with said piston guide, c) a multi-ribbed disc retainer attached to said piston on an end opposite the piston guide, d) poppet means slidably disposed within said disc retainer, e) said flow interrupting means having an interrupter disc along with the valve seal, contiguously compressed between said piston and said disc retainer, the valve seal providing a leak-proof closure, shutting off the flow of water when the valve seal is interfaced with the valve seat, f) a metering push-rod having an upper section slidably disposed within the internal flow passage of the piston guide so as to meter pilot flow, a lower section loosely fitting in the internal flow passage of the poppet means, and a shoulder between the two sections suitable to push the poppet means off its seat, and g) said poppet means held under the influence of a poppet compression spring, having an annular seal at an upper end, an internal flow passage with flow restricting means within, and a filter at the lower end, such that when the bonnet chamber is pressurized by closing the pilot flow exit port, the flow control valve closes in two distinct steps:

(1) a rapid movement of the piston occurs during the first part of the stroke when a primary pilot flowpath is formed around the poppet means and through the annular space between the upper section of the metering push rod and the axial flowpath of the piston guide, allowing rapid flow of water into the bonnet chamber, and (2) a slow movement at the end of the stroke when the primary pilot flowpath is sealed by the poppet means, allowing a smaller flow through said flow restriction means within said poppet means.

21. The flow control valve as recited in claim 20 wherein said poppet means further comprises a poppet body having an upper end and a lower end, with the upper end having poppet compression spring retaining means, poppet seal retaining means, and an internal flow passage connecting with the lower end, such flow passage containing flow restricting means in the form of a plurality of orifices in series, and filter retaining means.

22. The flow control valve as recited in claim 15, further comprising a variable pilot flow orifice at the inlet to the bonnet chamber for producing in the flow control valve an opening rate which is sufficiently slow in the early part of the opening stroke to eliminate potentially destructive pressure surges in lines or system components downstream of the valve.

23. The flow control valve as recited in claim 22 wherein said variable pilot flow orifice consists of a rod having a tapered metering section slidably disposed within a narrowed area of the pilot flowpath and keyed to the stroking of the piston, at the inlet of the bonnet chamber for the purpose of slowing the initial opening rate of the flow control valve, while assuring an adequate opening rate for the rest of the opening stroke.

24. The flow control valve as recited in claim 15 wherein said flow interrupting means comprises a interrupter disc as a flowpath, wherein said interrupter disc further having a concave outer surface with alignment ribs, and an outside diameter at the bottom edge sized to slide through the flow control valve seat with a slip fit, when said valve is closing and the piston is descending toward the seat, as the interrupter disc first enters the seat, as travel continues, the concavity creates a flowpath until the valve seal is contiguous with the seat, thereby forming a brief flushing cycle of restricted flow during valve closure.

* * * * *